US011842675B2

(12) United States Patent
Lee et al.

(10) Patent No.: US 11,842,675 B2
(45) Date of Patent: Dec. 12, 2023

(54) DISPLAY DEVICE

(71) Applicant: Samsung Display Co., Ltd., Yongin-si (KR)

(72) Inventors: Dong Won Lee, Suwon-si (KR); Byung Ki Chun, Seoul (KR); Joon-Chul Goh, Suwon-si (KR); Bonghyun You, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/731,187

(22) Filed: Apr. 27, 2022

(65) Prior Publication Data

US 2023/0005417 A1 Jan. 5, 2023

(30) Foreign Application Priority Data

Jul. 1, 2021 (KR) ..... 10-2021-0086252

(51) Int. Cl.
*G09G 3/32* (2016.01)

(52) U.S. Cl.
CPC ..... *G09G 3/32* (2013.01); *G09G 2300/0426* (2013.01); *G09G 2300/0452* (2013.01); *G09G 2300/0842* (2013.01); *G09G 2310/0278* (2013.01); *G09G 2320/0271* (2013.01); *G09G 2320/043* (2013.01); *G09G 2320/045* (2013.01)

(58) Field of Classification Search
CPC ... G09G 3/32–3291; G09G 2300/0426; G09G 2300/0452; G09G 2300/0842; G09G 2310/0243; G09G 2310/027–0278; G09G 2310/0289; G09G 2310/06; G09G 2310/08; G09G 2320/0233; G09G 2320/0242; G09G 2320/0271; G09G 2320/029; G09G 2320/0295; G09G 2320/04; G09G 2320/043; G09G 2320/045
See application file for complete search history.

(56) References Cited

U.S. PATENT DOCUMENTS 10,522,081 B2 12/2019 Kim et al.
10,573,236 B1 2/2020 Gao et al.
(Continued)

FOREIGN PATENT DOCUMENTS

KR 10-2017-0021678 2/2017
KR 10-2018-0077412 7/2018
KR 10-2020-0013823 2/2020

*Primary Examiner* — Nathan Danielsen
(74) *Attorney, Agent, or Firm* — H.C. Park & Associates, PLC

(57) ABSTRACT

A display device includes a display panel including a plurality of pixels respectively connected to a plurality of data lines and a plurality of scan lines, a data driving circuit for driving the plurality of data lines, a scan driving circuit for driving the plurality of scan lines, and a driving controller for receiving a control signal and an image signal and controlling the data driving circuit and the scan driving circuit such that an image is displayed on the display panel. The driving controller identifies a first region and a second region of an image to be displayed on the display panel based on the image signal and provides the data driving circuit with an image data signal obtained by compensating for the image signal to be provided to pixels adjacent to the second region among pixels corresponding to the first region as a compensation value.

20 Claims, 11 Drawing Sheets

(56) References Cited

U.S. PATENT DOCUMENTS

| | | | | |
|---|---|---|---|---|
| 11,030,971 | B2 | 6/2021 | Lee | |
| 2016/0225319 | A1* | 8/2016 | Lee | G09G 3/3275 |
| 2017/0206819 | A1* | 7/2017 | Pyo | G09G 3/3225 |
| 2017/0345377 | A1* | 11/2017 | Oh | G09G 3/3291 |
| 2018/0047350 | A1* | 2/2018 | Guo | G09G 3/3225 |

* cited by examiner

DISPLAY DEVICE

CROSS REFERENCE TO RELATED APPLICATIONS

This application claims priority from and the benefit of Korean Patent Application No. 10-2021-0086252, filed on Jul. 1, 2021, which is hereby incorporated by reference for all purposes as if fully set forth herein.

BACKGROUND

Field

Embodiments of the invention relate generally to a display device and more specifically, to a display device with a compensation circuit for compensating for image data according to degradation of pixels thereof.

Discussion of the Background

In general, a display device includes a display panel for displaying an image and a driving circuit for driving the display panel. The display panel includes a plurality of scan lines, a plurality of data lines, and a plurality of pixels. The driving circuit includes a data driving circuit for outputting a data driving signal to the data lines, a scan driving circuit for outputting a scan signal for driving the scan lines, and a driving controller for controlling the data driving circuit and the scan driving circuit.

Such a display device may output a scan signal to a scan line connected to a pixel to be displayed and may provide a data line connected to the pixel with a data voltage corresponding to a display image to display an image.

The above information disclosed in this Background section is only for understanding of the background of the inventive concepts, and, therefore, it may contain information that does not constitute prior art.

SUMMARY

Display devices constructed according to the principles of the invention are capable of improving display quality by compensating for image data according to degradation of pixels of the display devices.

Additional features of the inventive concepts will be set forth in the description which follows, and in part will be apparent from the description, or may be learned by practice of the inventive concepts.

According to an aspect of the invention, a display device includes a display panel including a plurality of pixels and a driving circuit that receives an image signal and provides a data signal to the plurality of pixels such that an image is displayed on the display panel. The driving circuit includes a stress map generator that divides the image signal into a plurality of blocks and generates a stress map including a representative value of each of the plurality of blocks, a compensation value calculator that calculates a compensation value corresponding to each of the plurality of pixels based on the stress map, and a compensator that outputs the data signal obtained by compensating the image signal based on the compensation value, when a gray scale level of the image signal is less than or equal to a reference gray scale level.

The stress map may include a first representative value of a first block among the plurality of blocks and a second representative value of a second block adjacent to the first block. The compensation value of a target pixel in the second block may be calculated by interpolation calculation using the first representative value and the second representative value.

The first representative value of the first block may be a compensation value of a first central pixel located at a center of the first block. The second representative value of the second block may be a compensation value of a second central pixel located at a center of the second block.

The compensation value of the target pixel may be calculated by the first representative value, the second representative value, a distance between the first central pixel and the target pixel, and a distance between the second central pixel and the first central pixel.

A compensation value of each of pixels between the first central pixel and the second central pixel may gradually decrease as moving from the second central pixel from the first central pixel, when the first representative value is greater than the second representative value.

The stress map generator may be configured to generate the stress map including a first representative value of a first block among the plurality of blocks and a second representative value of a second block adjacent to the first block. The compensation value calculator may be configured to calculate the compensation value of a target pixel in the second block by interpolation calculation using the first representative value and the second representative value.

The plurality of pixels may include first color subpixels, second color subpixels, and third color subpixels. A compensation value corresponding to each of the first color subpixels, the second color subpixels, and the third color subpixels may be set to a representative value of a first block, when the image signal corresponding to each of first color subpixels and second color subpixels in the first block among the plurality of blocks corresponds to a maximum gray scale level and when the image signal corresponding to each of the third color subpixels corresponds to a minimum gray scale level.

The compensator may be configured to compensate for the image signal corresponding to each of the third color subpixels as the compensation value.

Each of the plurality of blocks may correspond to A×B pixels, where each of A and B is a natural number.

The representative value of each of the plurality of blocks may be an arithmetic mean of image signals corresponding to the A×B pixels.

Each of the plurality of pixels may include a first transistor including a first electrode for receiving a first driving voltage, a second electrode, and a gate electrode, a light emitting diode including a first electrode electrically connected to the second electrode of the first transistor and a second electrode for receiving a second driving voltage, a second transistor including a first electrode for receiving the data signal, a second electrode electrically connected to the gate electrode of the first transistor, and a gate electrode for receiving a first scan signal, a third transistor including a first electrode for receiving an initialization voltage, a second electrode electrically connected to the second electrode of the first transistor, and a gate electrode for receiving a second scan signal, and a capacitor connected between the gate electrode of the first transistor and the second electrode of the first transistor.

The compensation value may be set to a value for compensating for a change in threshold voltage of the first transistor.

The driving circuit may include a data driving circuit that drives a plurality of data lines connected to the plurality of pixels, a scan driving circuit that drives a plurality of scan lines connected to the plurality of pixels, and a driving controller that receives a control signal and the image signal and controls the data driving circuit and the scan driving circuit.

According to another aspect of the invention, a display device includes a display panel including a plurality of pixels and a driving circuit that receives an image signal and provide a data signal to the plurality of pixels such that an image is displayed on the display panel. Each of the plurality of pixels includes a light emitting diode and at least one transistor for supplying current corresponding to the data signal to the light emitting diode. The driving circuit includes a stress map generator that divides the image signal into a plurality of blocks and generates a stress map including a representative value of each of the plurality of blocks, a compensation value calculator that calculates a compensation value corresponding to each of the plurality of pixels based on the stress map, and a compensator that outputs the data signal obtained by compensating the image signal such that a change in threshold voltage of the at least one transistor is compensated based on the compensation value, when a gray scale level of the image signal is less than or equal to a reference gray scale level.

The stress map may include a first representative value of a first block among the plurality of blocks and a second representative value of a second block adjacent to the first block. The compensation value of a target pixel in the second block may be calculated by interpolation calculation using the first representative value and the second representative value.

The first representative value of the first block may be a compensation value of a first central pixel located at a center of the first block. The second representative value of the second block may be a compensation value of a second central pixel located at a center of the second block.

The compensation value of the target pixel may be calculated by the first representative value, the second representative value, a distance between the first central pixel and the target pixel, and a distance between the second central pixel and the first central pixel.

Each of the plurality of pixels may include a first transistor including a first electrode for receiving a first driving voltage, a second electrode, and a gate electrode, a light emitting diode including a first electrode electrically connected to the second electrode of the first transistor and a second electrode for receiving a second driving voltage, a second transistor including a first electrode for receiving the data signal, a second electrode electrically connected to the gate electrode of the first transistor, and a gate electrode for receiving a first scan signal, a third transistor including a first electrode for receiving an initialization voltage, a second electrode electrically connected to the second electrode of the first transistor, and a gate electrode for receiving a second scan signal, and a capacitor connected between the gate electrode and the second electrode of the first transistor.

The compensator may be configured to output the data signal obtained by compensating the image signal such that a change in the threshold voltage of the at least one transistor is compensated based on the compensation value, when the gray scale level of the image signal is less than or equal to the reference gray scale level.

Each of the plurality of blocks may correspond to A×B pixels, where each of A and B is a natural number.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

DETAILED DESCRIPTION

Figure 1:
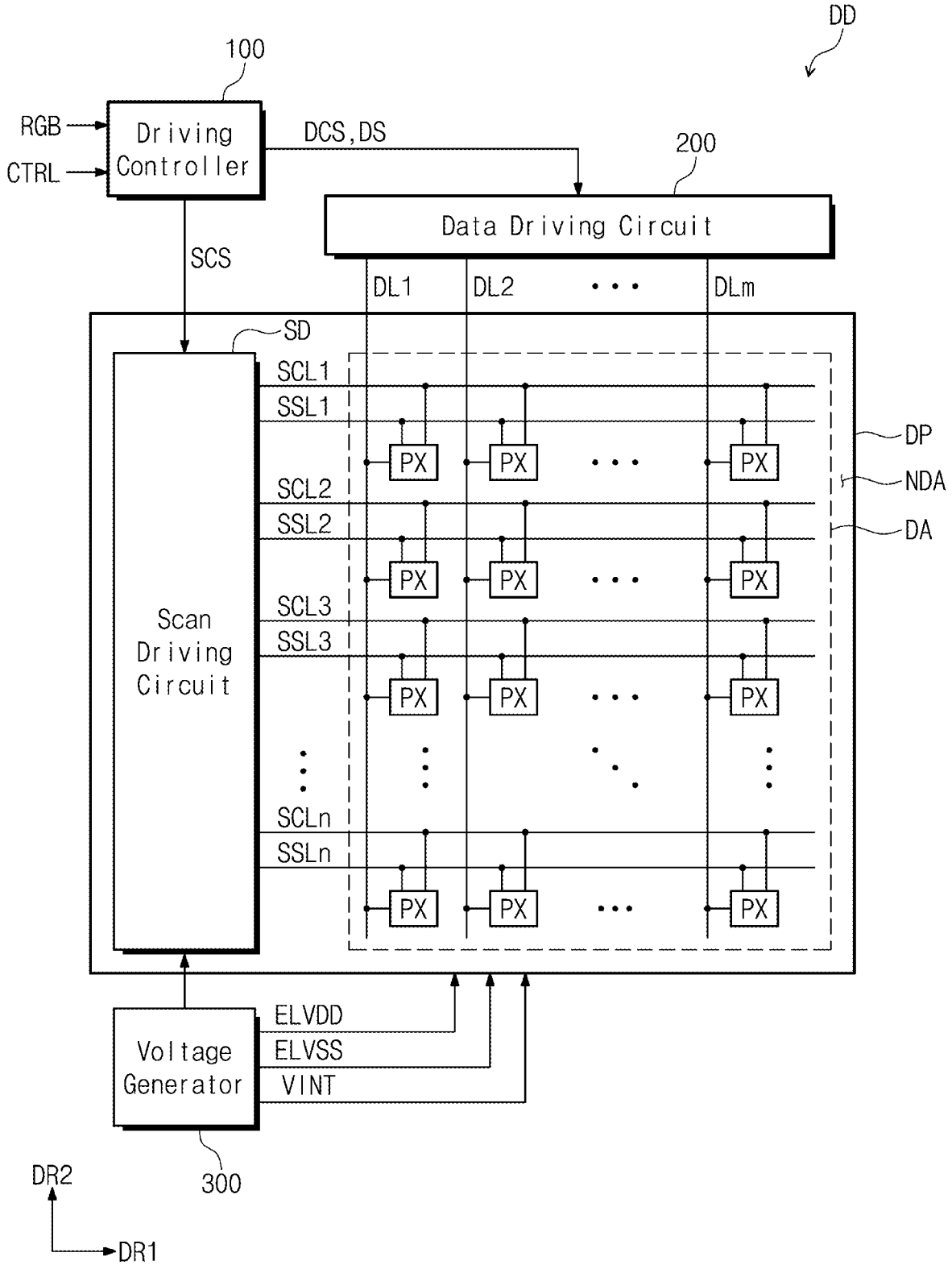
FIG. 1 illustrates a schematic diagram of an embodiment of a display device constructed according to the principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the DR1-axis, the DR2-axis, and the DR3-axis are not limited to three axes of a rectangular coordinate system, such as the x, y, and z-axes, and may be interpreted in a broader sense. For example, the DR1-axis, the DR2-axis, and the DR3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, embodiments will be described with reference to the accompanying drawings.

FIG. 1 is a block diagram of a display device according to an embodiment.

Referring to FIG. 1, a display device DD may include a display panel DP, a driving controller 100, a data driving circuit 200, and a voltage generator 300.

The driving controller 100 may receive an image signal RGB and a control signal CTRL. The driving controller 100 may generate an image data signal DS by converting a data format of the image signal RGB into a data format that is suitable or compatible with interface specifications of the data driving circuit 200. The driving controller 100 may output a scan control signal SCS and a data control signal DCS. In an embodiment, the driving controller 100 may output a voltage control signal VC corresponding to an operation mode.

The data driving circuit 200 may receive the data control signal DCS and the image data signal DS from the driving controller 100. The data driving circuit 200 may convert the image data signal DS into data signals and may output the data signals to a plurality of data lines DL1 to DLm which will be described below. The data signals may be analog voltages corresponding to a gray scale level of the image data signal DS.

The display panel DP may include first scan lines SCL1 to SCLn, second scan lines SSL1 to SSLn, data lines DL1 to DLm, and pixels PX. The display panel DP may further include a scan driving circuit SD. In an embodiment, the scan driving circuit SD may be arranged at a first side of the display panel DP. The first scan lines SCL1 to SCLn and the second scan lines SSL1 to SSLn may be extended in a first direction DR1 from the scan driving circuit SD.

The driving controller 100, the data driving circuit 200, and the scan driving circuit SD may be a driving circuit which provides a data signal to the pixels PX of the display panel DP.

The display panel DP may be divided into a display area DA and a non-display area NDA. The pixels PX may be disposed on the display area DA, and the scan driving circuit SD may be disposed on the non-display area NDA.

The first scan lines SCL1 to SCLn and the second scan lines SSL1 to SSLn may be arranged spaced apart from each other in a second direction DR2. The data lines DL1 to DLm may be extended in a direction opposite to the second direction DR2 from the data driving circuit 200 and may be arranged spaced apart from each other in the first direction DR1.

The plurality of pixels PX may be respectively and electrically connected to the first scan lines SCL1 to SCLn, the second scan lines SSL1 to SSLn, and the data lines DL1 to DLm. For example, the pixels of a first row may be connected to the scan lines SCL1 and SSL1. Furthermore, the pixels of a second row may be connected to the scan lines SCL2 and SSL2.

Each of the plurality of pixels PX may include a light emitting diode ED (refer to FIG. 3) and a pixel circuit PXC (refer to FIG. 3) for controlling light emission of the light emitting diode ED. The pixel circuit PXC may include a plurality of transistors and a capacitor. The scan driving circuit SD may include transistors formed by the same process as forming the pixel circuit PXC.

Each of the plurality of pixels PX may receive a first driving voltage ELVDD, a second driving voltage ELVSS, and an initialization voltage VINT.

The scan driving circuit SD may receive a scan control signal SCS from the driving controller 100. The scan driving circuit SD may output first scan signals to the first scan lines SCL1 to SCLn and may output second scan signals to the second scan lines SSL1 to SSLn, in response to the scan control signal SCS. A circuit configuration and an operation of the scan driving circuit SD will be described in detail below.

In an embodiment, the scan driving circuit SD may be disposed at the first side of the display area DA, and embodiments are not limited thereto. In an embodiment, the scan driving circuit SD may be respectively disposed at the first side and a second side of the display area DA. For example, the scan driving circuit disposed at the first side of the display area DA may provide the first scan signals to the first scan lines SCL1 to SCLn, and the scan driving circuit disposed at the second side of the display area DA may provide the second scan signals to the second scan lines SSL1 to SSLn.

The voltage generator 300 may generate voltages necessary for an operation of the display panel DP. In an embodiment, the voltage generator 300 may generate the first driving voltage ELVDD, the second driving voltage ELVSS, and the initialization voltage VINT, which are necessary for an operation of the display panel DP. The voltage generator 300 may further generate various voltages necessary for operations of the display panel DP and the scan driving circuit SD as well as the first driving voltage ELVDD, the second driving voltage ELVSS, and the initialization voltage VINT.

Figure 2:
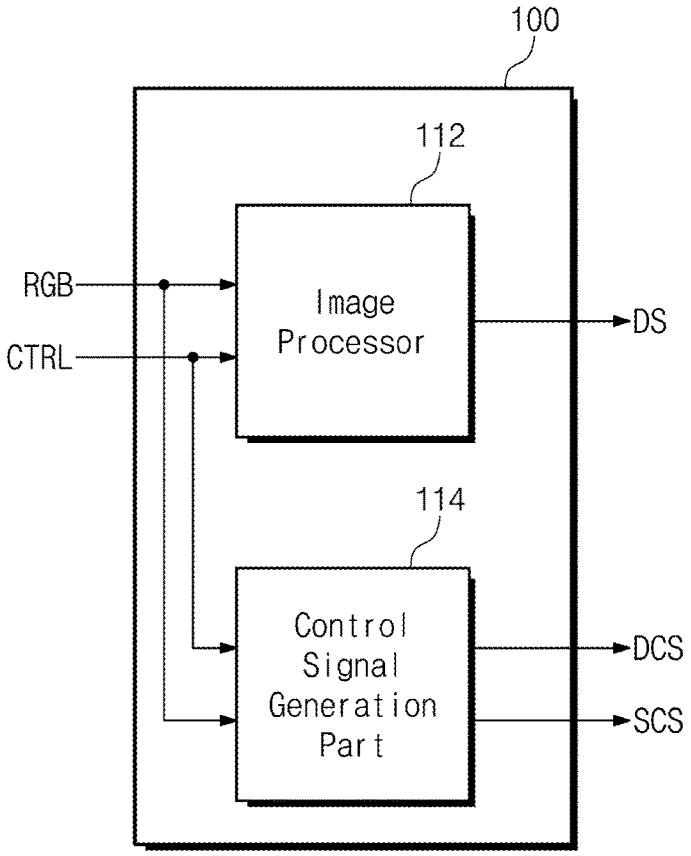
FIG. 2 is a schematic diagram of a driving controller of the display device of FIG.

FIG. 2 is a block diagram of a driving controller according to an embodiment.

As shown in FIG. 2, a driving controller 100 may include an image processor 112 and a control signal generator 114.

The image processor 112 may output an image data signal DS in response to an image signal RGB and a control signal CTRL.

The control signal generator 114 may output a data control signal DCS and a scan control signal SCS in response to the image signal RGB and the control signal CTRL.

Figure 3:
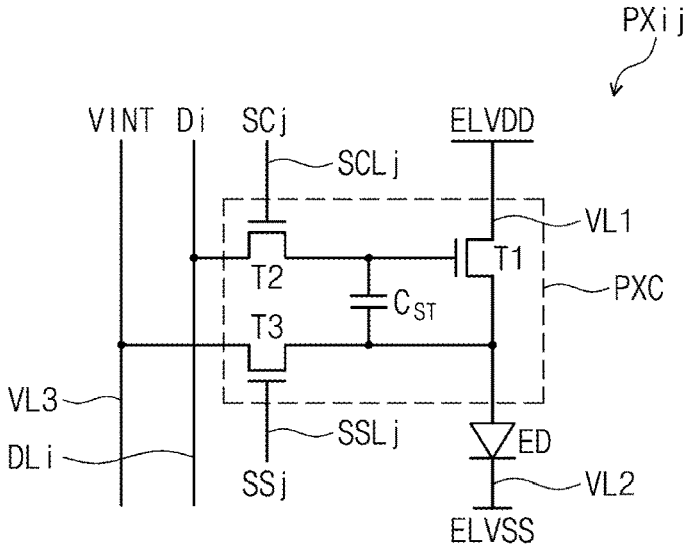
FIG. 3 is an equivalent circuit diagram of a representative pixel of a display panel of the display device of FIG. 1.

FIG. 3 is an equivalent circuit diagram of a representative pixel according to an embodiment.

FIG. 3 illustrates an equivalent circuit diagram of a pixel PXij connected to an i-th data line DLi among data lines DL1 to DLm shown in FIG. 1, a j-th first scan line SCLj among first scan lines SCL1 to SCLn, and a j-th second scan line SSLj among second scan lines SSL1 to SSLn.

Each of a plurality of pixels PX shown in FIG. 1 may have the same circuit configuration as the equivalent circuit diagram shown in FIG. 3. In an embodiment, the pixel PXij may include at least one light emitting diode ED and a pixel circuit PXC.

The pixel circuit PXC may include at least one transistor, which is electrically connected to the light emitting diode ED and supplies current corresponding to a data signal Di transmitted from a data line DLi to the light emitting diode ED. In an embodiment, the pixel circuit PXC of the pixel PXij may include a first transistor T1, a second transistor T2, a third transistor T3, and a capacitor Cst. Each of the first, second, and third transistors T1, T2, and T3 may be an N-type transistor which has an oxide semiconductor as a semiconductor layer. However, embodiments are not limited thereto, and each of the first, second, and third transistors T1, T2, and T3 may be a P-type transistor with a low-temperature polycrystalline silicon (LTPS) semiconductor layer. In an embodiment, at least one of the first, second, and third transistors T1, T2, and T3 may be the N-type transistor, and the remaining ones may be the P-type transistor. Furthermore, embodiments are not limited to the circuit configuration of the pixel in FIG. 3. The pixel circuit PXC of FIG. 3 is merely illustrative, and the configuration of the pixel circuit PXC may be modified and implemented.

Referring to FIG. 3, the first scan line SCLj may transmit a first scan signal SCj, and the second scan line SSLj may transmit a second scan signal SSj. A data line DLi may transmit a data signal Di. The data signal Di may have a voltage level corresponding to an image signal RGB, which is input to a display device DD (refer to FIG. 1).

A display panel DP of FIG. 1 may include first, second, and third voltage lines VL1, VL2, and VL3. The first voltage line VL1 and the third voltage line VL3 may transmit a first driving voltage ELVDD and an initialization voltage VINT to the pixel circuit PXC, and the second voltage line VL2 may transmit a second driving voltage ELVSS to a cathode (e.g., a second terminal) of the light emitting diode ED. The third voltage VL3 may be an initialization voltage line which transmits the initialization voltage VINT to the pixel circuit PXC.

The first transistor T1 may include a first electrode (e.g., a drain electrode) connected to the first voltage line VL1, a second electrode (e.g., a source electrode) electrically connected to an anode (e.g., a first terminal) of the light emitting diode ED, and a gate electrode connected to one end of the capacitor Cst. The first transistor T1 may supply a driving current to the light emitting diode ED in response to the data signal Di transmitted by the data line DLi according to a switching operation of the second transistor T2.

The second transistor T2 may include a first electrode connected to the data line DLi, a second electrode connected to the gate electrode of the first transistor T1, and a gate electrode connected to the first scan line SCLj. When the second transistor T2 is turned on according to the first scan signal SCj transmitted through the first scan line SCLj, the second transistor T2 may transmit the data signal Di, which is transmitted from the data line DLi, to the gate electrode of the first transistor T1.

The third transistor T3 may include a first electrode connected to the third voltage line VL3, a second electrode connected to the anode of the light emitting diode ED, and a gate electrode connected to the second scan line SSLj. When the third transistor T3 is turned on according to the second scan signal SSj transmitted through the second scan line SSLj, the third transistor T3 may transmit the initialization voltage VINT to the anode of the light emitting diode ED.

As described above, one end of the capacitor Cst may be connected to the gate electrode of the first transistor T1, and the other end may be connected to the second electrode of the first transistor T1. The structure of the pixel PXij according to an embodiment is not limited to the structure shown in FIG. 3, the number of transistors, the number of capacitors, and a connection structure, which are included in the one pixel PXij, may be modified in various manners.

Figure 4:
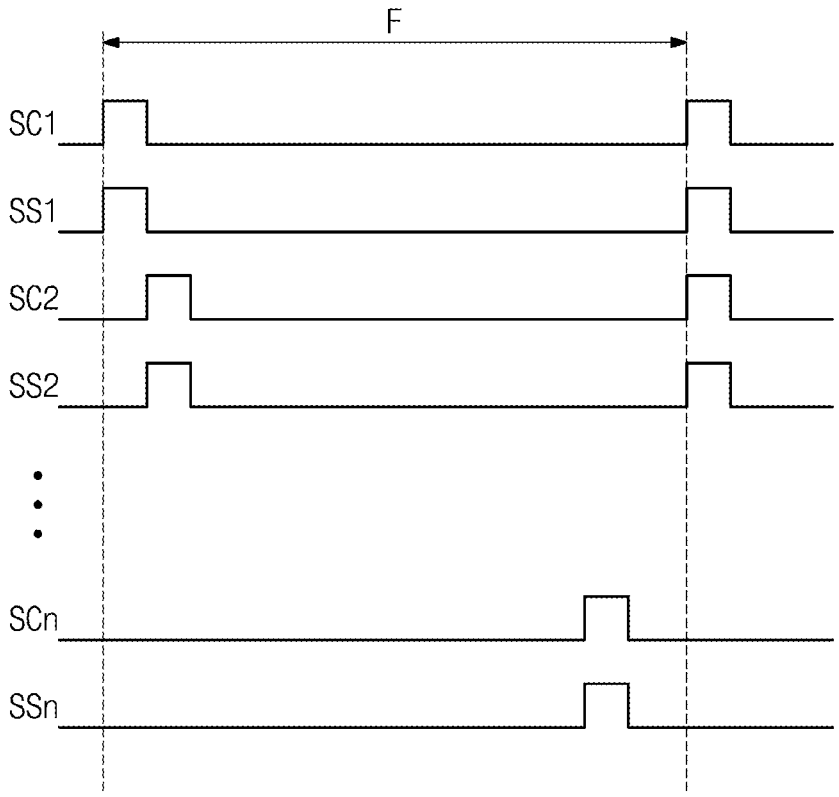
FIG. 4 is a timing diagram illustrating an operation of the pixel of FIG. 3.

FIG. 4 is a drawing illustrating first scan signals and second scan signals.

Referring to FIGS. 3 and 4, a scan driving circuit SD may respectively and sequentially enable first scan signals SC1-SCn and second scan signals SS1-SSn as a high voltage (e.g., gate-on voltage or turn-on voltage) during one frame F.

It is shown in FIG. 4 that signals corresponding to each other among the first scan signals SC1-SCn and the second scan signals SS1-SSn are enabled at the same time, but embodiments are not limited thereto. For example, after the second scan signal SS1 is firstly enabled, the first scan signal SC1 may be enabled. After the second scan signal SS2 is firstly enabled, the first scan signal SC2 may be enabled.

When the second scan signal SSj is transitioned to a high voltage, as the third transistor T3 is turned on, the initialization voltage VINT may be transmitted to an anode of a light emitting diode ED. The initialization voltage VINT may be, e.g., 2 V. The light emitting diode ED may be initialized to the initialization voltage VINT.

When the first scan signal SCj is transitioned to the high voltage, as the second transistor T2 is turned on, the data signal Di may be transmitted to a gate electrode of a first transistor T1. The first transistor T1 may be turned on by the data signal Di, and a driving current corresponding to a gate-source voltage of the first transistor T1 may be supplied to the anode of the light emitting diode ED. In other words, a driving current corresponding to a difference between the data signal Di provided to the gate electrode of the first transistor T1 and the initialization voltage VINT may be supplied to the anode of the light emitting diode ED.

The data signal Di and the initialization voltage VINT may be provided to both ends of a capacitor Cst. Therefore, as each of the first scan signal SCj and the second scan signal SSj is transitioned to a low voltage, although the second transistor T2 and the third transistor T3 are turned off, the gate-source voltage of the first transistor T1 may be maintained at a constant level and a driving current may be supplied to the light emitting diode ED.

The data signal Di provided from a data driving circuit 200 may have a minimum gray scale voltage level (e.g., about 1 V) for a black image. For example, when the initialization voltage VINT is about 2 V, after the second transistor T2 and the third transistor T3 are turned on, the gate-source voltage Vgs of the first transistor T1 may be about −1 V. Because the gate-source voltage Vgs of the first transistor T1 is lower than a threshold voltage Vth, the first transistor T1 may be sufficiently turned off and the light emitting diode ED may display a black color image.

Figure 5:
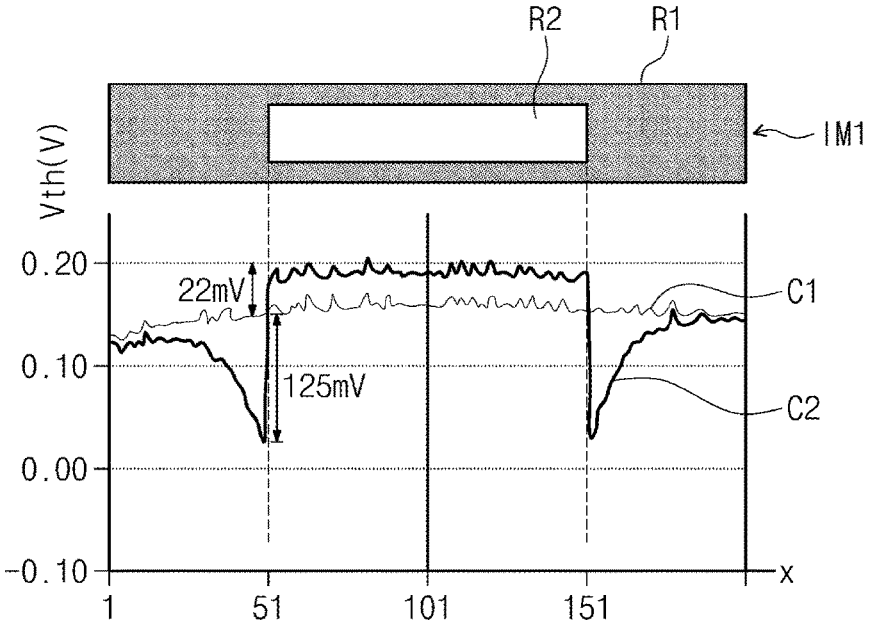
FIG. 5 is a drawing illustrating an image displayed on a display device and a graph illustrating changes in threshold voltages of pixels of the display panel of FIG. 1.

FIG. 5 is a drawing illustrating an image displayed on a display device and changes in threshold voltages of pixels.

On a graph shown in FIG. 5, the horizontal axis indicates the X-coordinate of the pixel in a first direction DR1 (refer to FIG. 1) and the vertical axis indicates the threshold voltage Vth of the pixel.

Referring to FIGS. 3 and 5, an image IM1 displayed on a display device DD (refer to FIG. 1) may include a first region R1 and a second region R2. The second region R2 may be in the form of a rectangle, and the first region R1 may be in the form of surrounding the second region R2. The first region R1 may display a black color image. The second region R2 may display a white color image. In an embodiment, the second region R2 may be a red region which displays an image where a red color has a maximum gray scale level (e.g., the highest gray scale level) and where each of a green color and a blue color has a minimum gray scale level (e.g., the lowest gray scale level). In an embodiment, the second region R2 may be a green region which displays an image where the green color has the maximum gray scale level and where each of the red color and the blue color has the minimum gray scale level. In an embodiment, the second region R2 may be a blue region which displays an image where the blue color has the maximum gray scale level and where each of the red color and the green color has the minimum gray scale level. In other words, the second region R2 may be a region which displays an image where one of the red color, the green color, and the blue color has the maximum gray scale level and where the two other colors have the minimum gray scale level.

A first curve C1 indicates a change in threshold voltage Vth of a first transistor T1 in pixels PX at a time when the image IM1 starts to be displayed on the display device DD.

A second curve C2 indicates a change in threshold voltage Vth of the first transistor T1 in the pixels PX when a certain time (e.g., 30 hours) elapses after the image IM1 is displayed on the display device DD.

Because the pixels PX of the first region R1 display a black color image, a gate-source voltage Vgs of the first transistor T1 in the pixels PX of the first region R1 may be, as described above, in a level (e.g., −1 V) lower than the threshold voltage Vth to be a negative bias.

Particularly, as the first transistor T1 in the pixels PX adjacent to the second region R2 in the first region R1 absorbs light output from the second region R2, there may be occur a phenomenon where the threshold voltage Vth is shifted to a negative. As an example, like the second curve C2, the threshold voltage Vth of the first transistor T1 in the pixels PX adjacent to the second region R2 in the first region R1 may be decreased by about 125 mV. For example, the threshold voltage Vth of the first transistor T1 may be negatively shifted by about 125 mV by applying the negative bias (e.g., about −1 V) to the first transistor T1.

On the other hand, the gate-source voltage Vgs of the first transistor T1 in the pixels PX of the second region R2 may have a level higher than the threshold voltage Vth to be a positive bias. Due to a positive bias stress, the threshold voltage Vth of the first transistor T1 in the pixels PX of the second region R2 may be positively shifted. As an example, like the second curve C2, the threshold voltage Vth of the first transistor T1 in the pixels PX of the second region R2 may be increased by about 22 mV. For example, the threshold voltage Vth of the first transistor T1 may be positively shifted by about 22 mV by applying the positive bias to the first transistor T1.

When the data signal Di of the same gray scale level is provided to the pixels PX of the first region R1 and the pixels PX of the second region R2 in a state where the threshold voltage Vth of the first transistor T1 in the pixels PX of the first region R1 is negatively shifted and where the threshold voltage Vth of the first transistor T1 in the pixels PX of the second region R2 is positively shifted, luminance of pixels at a location adjacent to the second region R2 among pixels of the first region R1 may be enhanced. Such an afterimage phenomenon may result in poor display quality.

Figure 6:
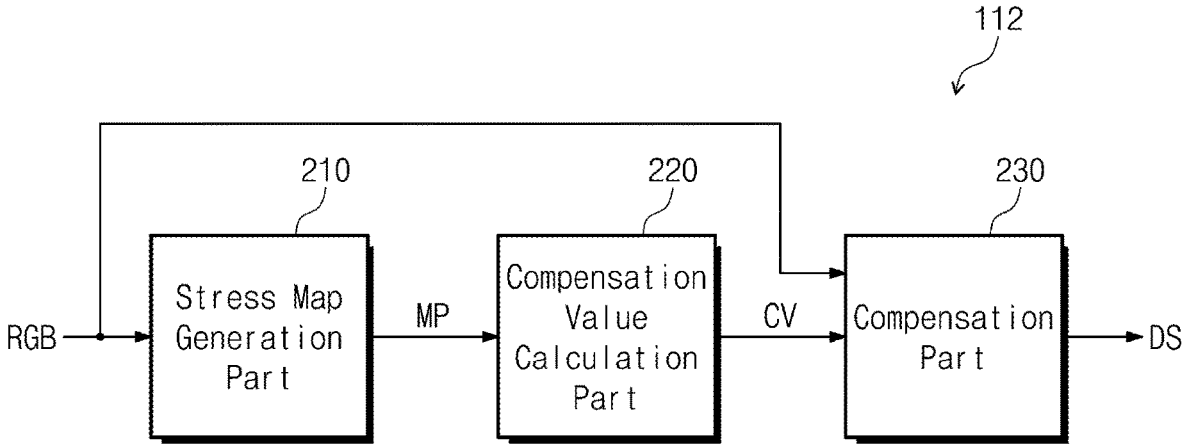
FIG. 6 is a schematic diagram of an image processor of the driving controller of FIG. 2.

FIG. 6 is a block diagram of an image processor according to an embodiment.

Referring to FIG. 6, an image processor 112 may include a stress map generator 210, a compensation value calculator 220, and a compensator 230.

The stress map generator 210 may receive an image signal RGB and may generate a stress map MP for the image signal RGB of one frame.

The compensation value calculator 220 may calculate a compensation value CV corresponding to each of pixels based on the stress map MP and may output the calculated compensation value CV.

The compensator 230 may output an image data signal DS obtained by compensating for the image signal RGB according to the compensation value CV corresponding to each of the pixels. The image data signal DS may be provided to a data driving circuit 200 of FIG. 1.

The image processor 112 may further include a convertor for converting an image signal RGB including red, green, and blue color signals into an HSV signal including hue, saturation, and luminance signals. The image processor 112 may provide the stress map generator 210 with the HSV signal converted by the convertor. In this case, because the signal output from the compensator 230 is the HSV signal including the hue, saturation, and luminance signals, the image processor 112 may further need an inverse convertor for inversely converting the HSV signal into an image data signal DS including red, green, and blue color signals.

Figure 7:
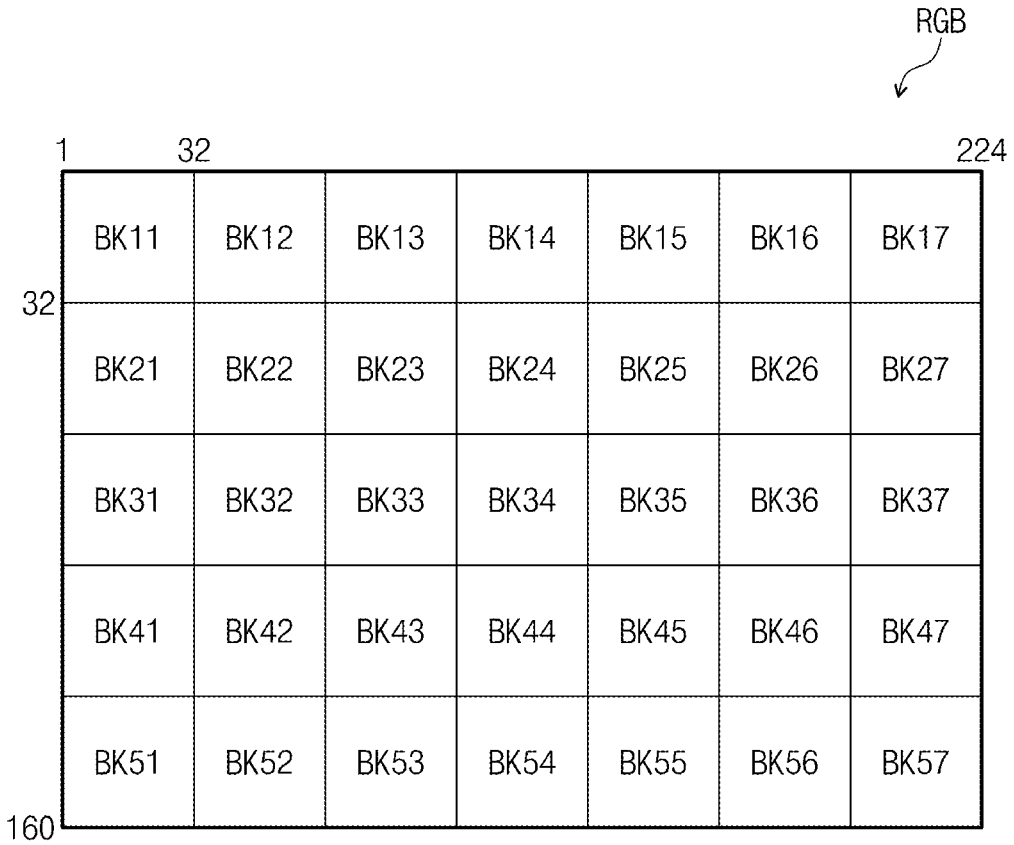
FIG. 7 is a drawing illustrating an operation of a stress map generator of the image processor of FIG. 6.

FIG. 7 is a drawing illustrating an operation of a stress map generator 210.

Referring to FIGS. 6 and 7, the stress map generator 210 may divide an image signal RGB of one frame into a plurality of blocks. In an example shown in FIG. 7, the stress map generator 210 may divide the image signal RGB into 7×5 (i.e., 35) blocks BK11 to BK17, BK21 to BK27, BK31 to BK37, BK41 to BK47, and BK51 to BK57. For example, each of the blocks BK11 to BK17, BK21 to BK27, BK31 to BK37, BK41 to BK47, and BK51 to BK57 may correspond to A×B pixels (where each of A and B is a natural number). For example, each of blocks BK11 to BK17, BK21 to BK27, BK31 to BK37, BK41 to BK47, and BK51 to BK57 may correspond to 32×32 pixels. In other words, one block may include image signals corresponding to 32×32 pixels.

In the example shown in FIG. 7, when one block corresponds to the 32×32 pixels, the blocks BK11 to BK17, BK21 to BK27, BK31 to BK37, BK41 to BK47, and BK51 to BK57 may correspond to 244×160 pixels.

The number of blocks shown in FIG. 7 and the size of each block (i.e., the number of pixels corresponding to each block) are merely an example provided for convenience of description, and embodiments are not limited to the example shown in FIG. 7.

The stress map generator 210 may calculate a representative value of each of the blocks BK11 to BK17, BK21 to BK27, BK31 to BK37, BK41 to BK47, and BK51 to BK57 of the image signal RGB. For example, the representative value of each of the blocks BK11 to BK17, BK21 to BK27, BK31 to BK37, BK41 to BK47, and BK51 to BK57 may be one of values capable of representing the block, for example, an arithmetic mean, a median, a mode, and the like of image signals in the block. In an embodiment, the stress map generator 210 may calculate an arithmetic mean of image signals in each of the blocks BK11 to BK17, BK21 to BK27, BK31 to BK37, BK41 to BK47, and BK51 to BK57 and may set the calculated result to a representative value. A stress map MP output from the stress map generator 210 may include a representative value of each of the blocks BK11 to BK17, BK21 to BK27, BK31 to BK37, BK41 to BK47, and BK51 to BK57.

Figure 8:
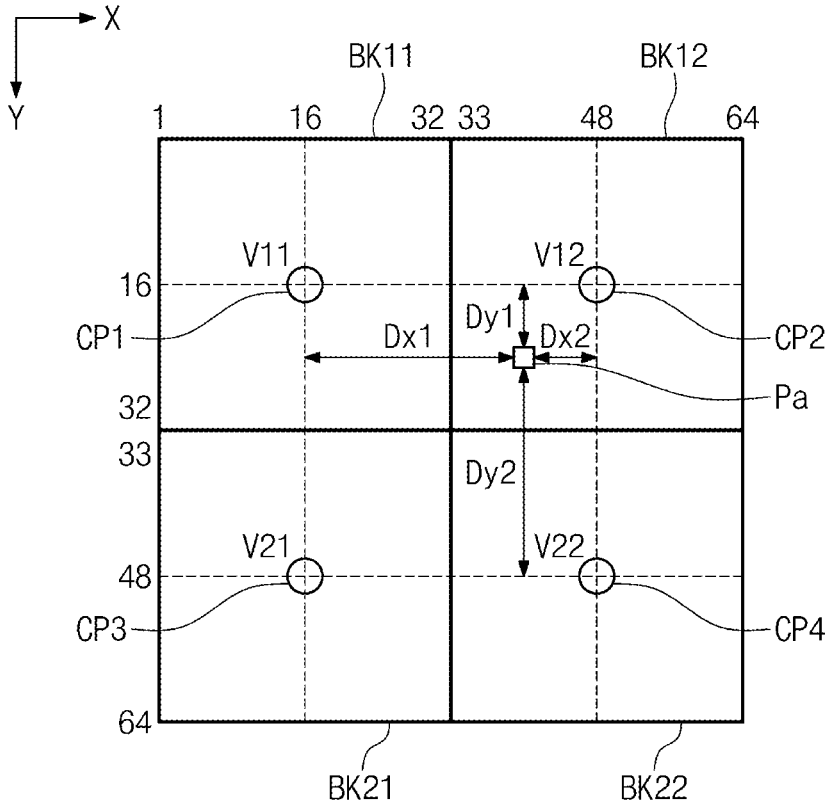
FIG. 8 is a drawing illustrating an operation of a compensation value calculator of the image processor of FIG. 6.

FIG. 8 is a drawing illustrating an operation of a compensation value calculator 220.

FIG. 8 illustrates some BK11, BK12, BK21, and BK22 of blocks BK11 to BK17, BK21 to BK27, BK31 to BK37, BK41 to BK47, and BK51 to BK57 shown in FIG. 7. The blocks BK11, BK12, BK21, and BK22 may have representative values V11, V12, V21, and V22 calculated by a stress map generator 210, respectively. Each of the representative values V11, V12, V21, and V22 may be a compensation value CV of a central pixel located at the center of a corresponding block among the blocks BK11, BK12, BK21, and BK22. In other words, the representative value V11 may be a compensation value CV of a first central pixel CP1 located at the coordinate (16, 16) which is the center of the block BK11, the representative value V12 may be a compensation value CV of a second central pixel CP2 located at the coordinate (48, 16) which is the center of the block BK12, the representative value V21 may be a compensation value CV of a third central pixel CP3 located at the coordinate (16, 48) which is the center of the block BK21, and the representative value V22 may be a compensation value CV of a fourth central pixel CP4 located at the coordinate (48, 48) which is the center of the block BK22. For example, the coordinates of the first, second, third, and fourth central pixels CP1, CP2, CP3, and CP4 are expressed according to an XY coordinate plane, which is defined an X-axis and a Y-axis in FIG. 8.

Referring to FIGS. 6 and 8, the compensation value calculator 220 may calculate a compensation value corresponding to each of pixels in the blocks BK11 to BK17, BK21 to BK27, BK31 to BK37, BK41 to BK47, and BK51 to BK57 based on a stress map MP.

The compensation value calculator 220 may calculate a compensation value CV corresponding to a pixel by means of interpolation calculation based on the representative values V11, V12, V21, and V22 and distances between the central pixels corresponding to the representative values V11, V12, V21, and V22 and target pixels.

Calculating a compensation value of a pixel Pa (i.e., a target pixel) in the block BK12 will be described as an example. A compensation value CV corresponding to the pixel Pa in the block BK12 may be calculated based on the representative value V12 of the block BK12 to which the pixel Pa belongs, representative values V11, V21, and V22 of the blocks BK11, BK21, and BK22 adjacent to the block BK12, and first, second, third, and fourth distances Dx1, Dx2, Dy1, and Dy2 between the first, second, and fourth central pixels CP1, CP2, and CP4 and the pixel Pa. For example, the first distance Dx1 may be a difference between the X-coordinate of the first central pixel CP1 (or the third central pixel CP3) and the X-coordinate of the pixel Pa. The second distance Dx2 may be a difference between the X-coordinate of the second central pixel CP2 (or the fourth central pixel CP4) and the X-coordinate of the pixel Pa. The third distance Dy1 may be a difference between the Y-coordinate of the first central pixel CP1 (or the second central pixel CP2) and the Y-coordinate of the pixel Pa. The fourth distance Dy2 may be a difference between the Y-coordinate of the third central pixel CP3 (or the fourth central pixel CP2) and the Y-coordinate of the pixel Pa.

When the representative value V11 of the block BK11 corresponds to a high gray scale level and when the representative value V12 of the block BK12 corresponds to a low gray scale level, a compensation value CV of the pixel Pa in the block BK12 may be determined according to the distance Dx1 between the first central pixel CP1 and the pixel Pa (e.g., in the X-axis direction) and the distance Dx2 between the second central pixel CP2 and the pixel Pa (e.g., in the X-axis direction). For example, the compensation values of pixels located between the first central pixel CP1 and the second central pixel CP2 may decrease as increasing the distance Dx1 (i.e., as decreasing the distance Dx2).

Figure 9:
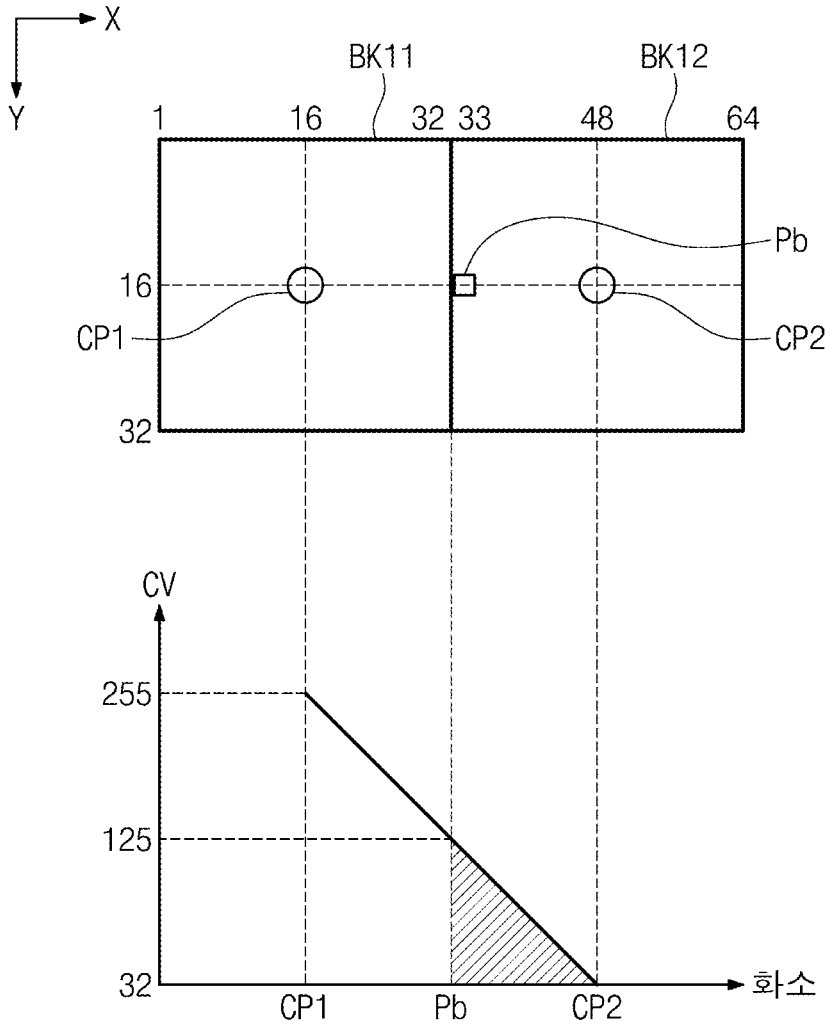
FIG. 9 is a drawing illustrating an operation of calculating compensation values for pixels in blocks by the compensation value calculator of the image processor of FIG. 6.

FIG. 9 is a drawing illustrating an operation of calculating compensation values for pixels in blocks BK11 and BK12 in a compensation value calculator 220.

Referring to FIGS. 8 and 9, it is assumed that all of pixels in the block BK11 display a white gray scale image and that all of pixels in the block BK12 display a black gray scale image. It is assumed that the black gray scale level corresponds to a gray scale level of 0 and that the white gray scale level corresponds to a gray scale level of 255.

A representative value V11 of the block BK11 may be a compensation value CV of a first central pixel CP1 located at the coordinate (16, 16), and a representative value V12 of the block BK12 may be a compensation value CV of a second central pixel CP2 located at the coordinate (48, 16). In an embodiment, it is assumed that the compensation value CV of the first central pixel CP1 is 255 and that the compensation value CV of the second central pixel CP2 is 0.

A compensation value CV of a pixel Pb (i.e., a target pixel) in the block BK12 adjacent to the block BK11 may be determined by the representative value V11 of the block BK11, the representative value V12 of the block BK12, and a distance between pixels CP1 and CP2, on which the representative values V11 and V12 are located, and the pixel Pb. For example, the compensation value CV of the pixel Pb may be 125.

Compensation values CV for pixels between the first central pixel CP1 in the block BK11 and the pixel Pb may gradually decrease as moving from the central pixel CP1 to the pixel Pb.

The compensation value calculator 220 may output 244×160 compensation values CV for 244×160 pixels using representative values for blocks BK11, BK12, BK21, and BK22 of blocks BK11 to BK17, BK21 to BK27, BK31 to BK37, BK41 to BK47, and BK51 to BK57.

A compensator 230 of FIG. 6 may compensate for an image signal RGB based on compensation values CV corresponding to pixels and may output an image data signal DS.

As described above referring to FIG. 5, when a threshold voltage Vth in pixels PX of a first region R1 which displays an image of black gray scale level is negatively shifted, an afterimage phenomenon may occur. Therefore, the compensator 230 may compensate for only an image signal RGB which has a black gray scale level (e.g., the lowest gray scale level) in the image signal RGB based on the compensation values CV. For example, when a gray scale level of the image signal RGB is less than or equal to a reference gray scale level, the compensator 230 may compensate for the image signal RGB based on the compensation values CV. The reference gray scale level may be set to a low gray scale level (e.g., a gray scale level of 20).

In an example shown in FIG. 9, the compensator 230 may not compensate for the image signal RGB corresponding to pixels in the block BK11 and may compensate for the image signal RGB corresponding to pixels in the block BK12 based on the compensation value CV.

At this time, a compensation value CV of a pixel adjacent to the block BK11 may be larger than a compensation value CV of a pixel far away from the block BK11. For example, as shown in FIG. 9, the compensation value CV of the pixel Pb is 125, and the compensation value of the second central pixel CP2 is 0.

In other words, the compensator 230 may compensate for the pixel Pb adjacent to the block BK11 which displays a white gray scale image as the compensation value CV higher than the second central pixel CP2. Therefore, the compensator 230 may prevent the threshold voltage Vth of the first transistor T1 in the pixel Pb from being negatively shifted.

Figure 10A:
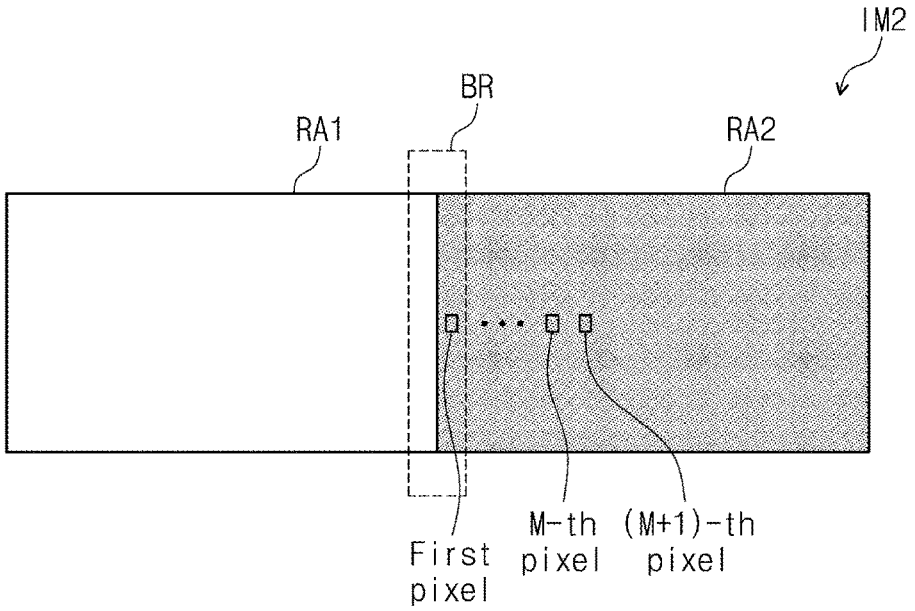
FIG. 10A illustrates an example of an image displayed on a display device.

FIG. 10A illustrates an example of an image IM2 displayed on a display device.

Referring to FIG. 10A, the image IM2 may include a first region RA1 and a second region RA2. The first region RA1 may display a white color image. The second region RA2 may display a black color image. A boundary region BR may be a region to which the first region RA1 and the second region RA2 are adjacent. For example, first to M-th pixels may be disposed in the second region RA2 adjacent to the first region RA1. The first pixel may be located to be spaced apart from the boundary region BR by the X-coordinate of 1. The M-th pixel may be located to be spaced apart from the boundary region BR by the X-coordinate of M. Herein, M is a natural number, which may vary with a characteristic of the image IM2.

Figure 10B:
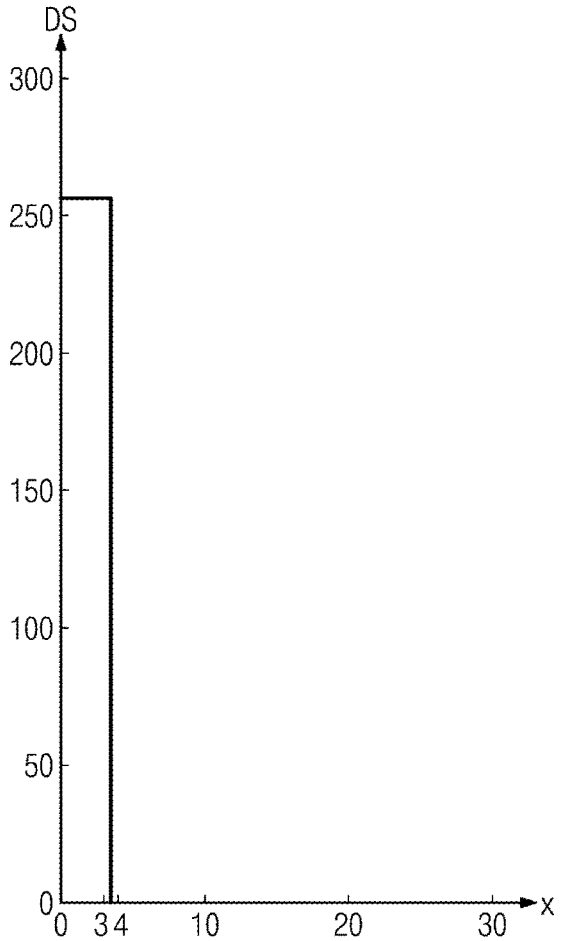
FIGS. 10B and 10C are drawings illustrating an image data signal corresponding to a boundary region of the image of FIG. 10A.
Figure 10C:
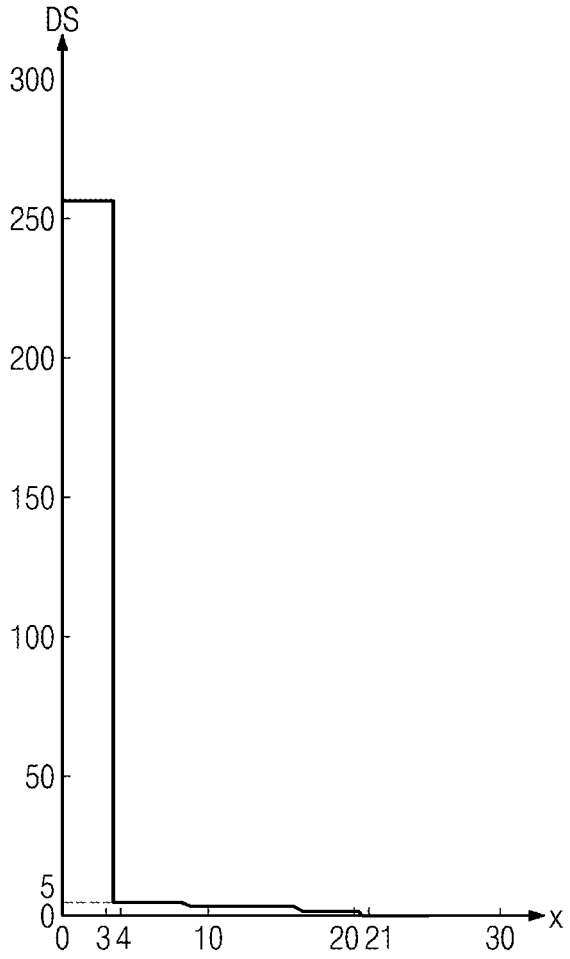

FIGS. 10B and 10C are drawings illustrating an image data signal DS corresponding to a boundary region BR of the image IM2 shown in FIG. 10A. In FIGS. 10B and 10C, the horizontal axis indicates the X-coordinate of the pixel in a first direction DR1 (refer to FIG. 1), and the vertical axis indicates the gray scale level of the image data signal DS.

FIG. 10B shows the image data signal DS output from an image processor 112, when the image processor 112 does not perform a compensation operation.

The image data signal DS to be provided to pixels corresponding to a first region RA1 in a boundary region BR may have a white gray scale level (e.g., a gray scale level of 255). The image data signal DS to be provided to pixels corresponding to a second region RA2 in the boundary region BR may have a black gray scale level (e.g., a gray scale level of 0). For example, the image data signal DS at the X-coordinate of 4 in FIG. 10B may be applied to the first pixel in FIG. 10A. For example, the image data signal DS at the X-coordinate of 20 in FIG. 10B may be applied to the M-th pixel in FIG. 10A.

FIG. 10C shows the image data signal DS output from the image processor 112, when the image processor 112 performs a compensation operation.

The image processor 112 may provide the image data signal DS having the white gray scale level (e.g., the gray scale level of 255) to each of pixels PX corresponding to the first region RA1 in the boundary region BR. The image processor 112 may provide the image data signal DS which is gradually lowered from a gray scale level (e.g., a gray scale level of 5) higher than a black gray scale level to each of the first to M-th pixels adjacent to the first region RA1 in the second region RA2 of the boundary region BR. In other words, compensation values CV respectively corresponding to the first to M-th pixels disposed on the second region RA2 in the boundary region BR may gradually increase as moving close to the first region RA1 from the second region RA2. For example, the image data signal DS at the X-coordinate of 4 in FIG. 10C may be applied to the first pixel in FIG. 10A. For example, the image data signal DS at the X-coordinate of 20 in FIG. 10C may be applied to the M-th pixel in FIG. 10A.

The image processor 112 may provide the image data signal DS having a black gray scale level (e.g., the gray scale level of 0) an (M+1)-th pixel among pixels corresponding to the second region RA2. For example, the (M+1)-th pixel may be spaced apart from the first region RA1 by the X-coordinate of (M+1). For example, the image data signal DS at the X-coordinate of 21 in FIG. 10C may be applied to the (M+1)-th pixel in FIG. 10A.

As described in FIG. 3, a threshold voltage Vth of a first transistor T1 of a pixel in the second region RA2 adjacent to the first region RA1 which displays a white gray scale image may be negatively shifted. Therefore, by providing a data signal Di of a gray scale level higher than the black gray scale level to each of first to M-th pixels adjacent to the first region RA1 in the second region RA2 of the boundary region BR, the image processor 112 may compensate for the negative shifting of the threshold voltage Vth of the first transistor T1.

Furthermore, by providing the image data signal DS gradually lowered from a gray scale level (e.g., a gray scale level of 5) higher than a black gray scale level to each of first to M-th pixels adjacent to the first region RA1 in the second region RA2 of the boundary region BR, the image processor 112 may prevent a user from recognizing a luminance change in a boundary region between the first region RA1 and the second region RA2. For example, the image data signal DS (e.g., the gray scale level of 5) at the X-coordinate of 4 in FIG. 10C may be applied to the first pixel in FIG. 10A. For example, the image data signal DS (e.g., a gray scale level of 1) at the X-coordinate of 20 in FIG. 10C may be applied to the M-th pixel in FIG. 10A. For example, the image data signal DS (e.g., the gray scale level of 0) at the X-coordinate of 21 in FIG. 10C may be applied to the (M+1)-th pixel in FIG. 10A FIG. 11 is a drawing illustrating an image displayed on a display device and changes in threshold voltages of pixels.

Figure 11:
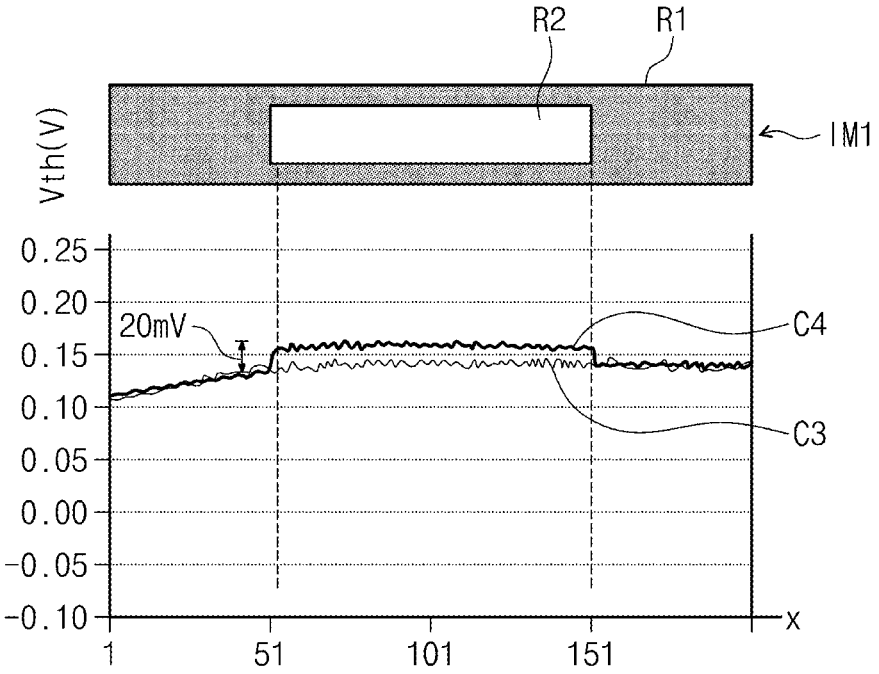
FIG. 11 is a drawing illustrating an image displayed on a display device and a graph illustrating changes in threshold voltages of pixels of the display panel of FIG. 1.

On a graph shown in FIG. 11, the horizontal axis indicates the X-coordinate of the pixel in a first direction DR1 (refer to FIG. 1) and the vertical axis indicates the threshold voltage Vth of the pixel.

An image IM1 of FIG. 11 may be the same as an image IM1 shown in FIG. 5. A second region R2 of the image IM1 may be in the form of a rectangle, and the first region R1 may be in the form of surrounding the second region R2. The first region R1 may display a black color image. The second region R2 may display a white color image. However, embodiments are not limited thereto. For example, the shape of the second region R2 of the image IM1 are varied.

A third curve C3 indicates a change in threshold voltage Vth of a first transistor T1 in pixels PX at a time when the image IM1 starts to be displayed on the display device DD.

A fourth curve C4 indicates a change in threshold voltage Vth of the first transistor T1 in the pixels PX when a certain time (e.g., 30 hours) elapses after the image IM1 is displayed on the display device DD. For example, like the second curve C4, the threshold voltage Vth of the first transistor T1 in the pixels PX of the second region R2 may be increased by about 20 mV. For example, the threshold voltage Vth of the first transistor T1 may be positively shifted by about 20 mV by applying the positive bias to the first transistor T1. For example, like the second curve C3, the threshold voltage Vth of the first transistor T1 in the pixels PX adjacent to the second region R2 in the first region R1 may not be decreased.

An image processor 112 of FIG. 6 may provide a data driving circuit 200 of FIG. 1 with an image data signal DS obtained by compensating for an image signal RGB using a compensation value CV. Thus, although the image IM1 is displayed for a long time on the display device DD, the image processor 112 may minimize the negative shifting of the threshold voltage Vth of the first transistor T1 in pixels PX of the first region R1.

Figure 12:
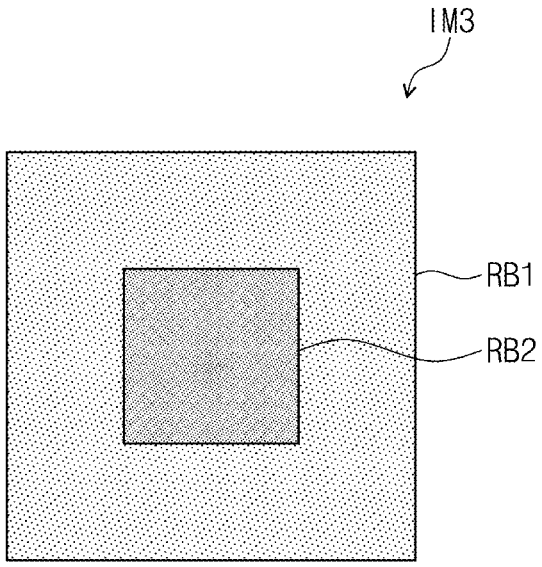
FIG. 12 illustrates an example of an image displayed on a display device.
Figure 13:
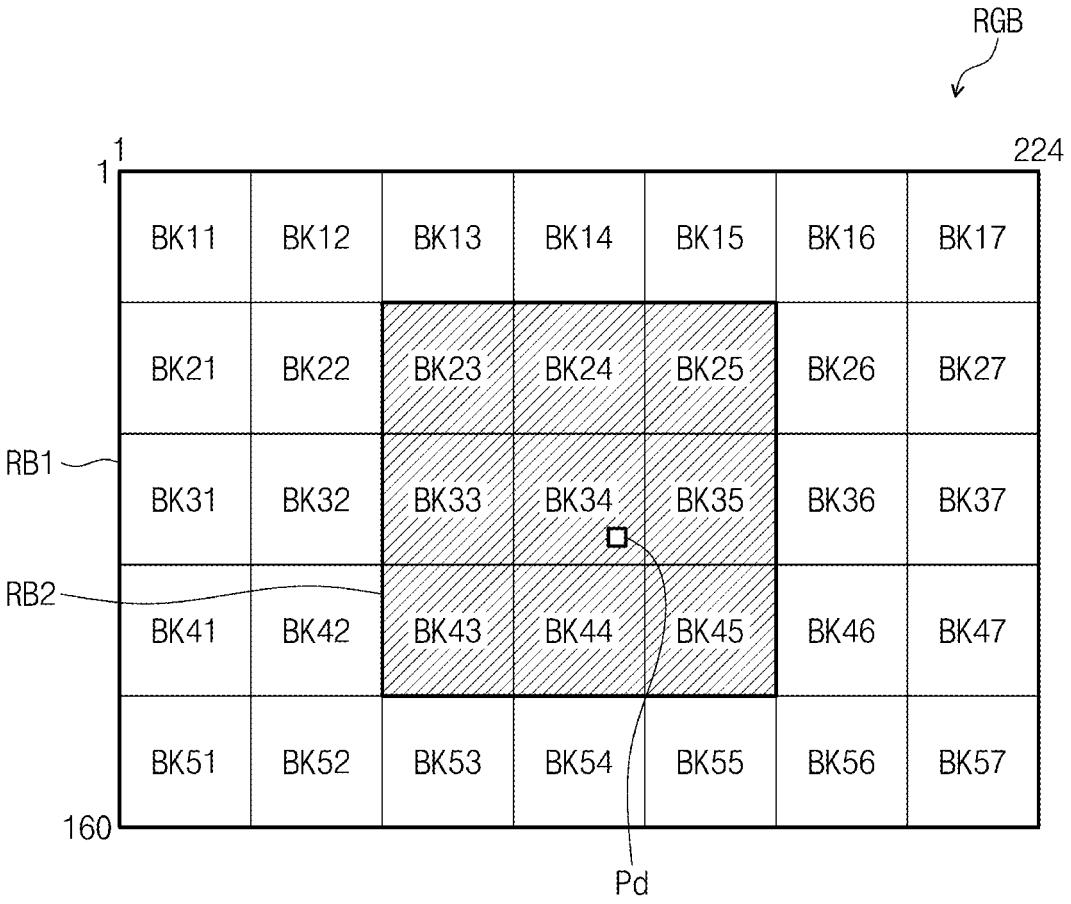
FIG. 13 is a drawing illustrating an operation of a stress map generator for the image of FIG. 12.

FIG. 12 illustrates an example of an image IM3 displayed on a display device. FIG. 13 is a drawing illustrating an operation of a stress map generator 210 for the image IM3 shown in FIG. 12.

Referring to FIGS. 12 and 13, a display device DD (refer to FIG. 1) may include a first region RB1 and a second region RB2. The second region RB2 may be in the form of a rectangle, and the first region RB1 may be in the form of surrounding the second region RB2. The second region RB2 may display a blue color image. The first region RB1 may display a black color image.

For example, the first region RB1 may correspond to blocks BK11 to BK17, BK21, BK22, BK26, BK27, BK31, BK32, BK36, BK37, BK41, BK42, BK46, BK47, and BK51 to BK57. The second region RB2 may correspond to BK23 to BK25, BK33 to BK35, and BK43 to BK45.

An image signal of pixels adjacent to the second region RB2 among pixels of the first region RB1 may be compensated by the scheme described in FIGS. 7 to 9. Therefore, it may be prevented that a threshold voltage of transistors in pixels of the second region RB2 is negatively shifted.

Figure 14:
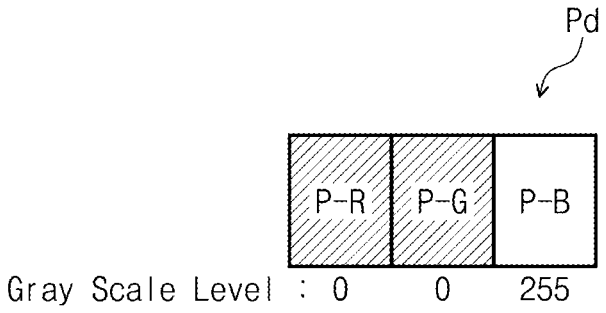
FIG. 14 is a drawing illustrating the pixel of FIG. 13.

FIG. 14 is a drawing illustrating the pixel Pd of FIG. 13.

Referring to FIG. 14, a pixel Pd may include a red subpixel P-R for emitting red color light, a green subpixel P-G for emitting green color light, and a blue subpixel P-B for emitting blue color light. An example in which the pixel Pd includes the red subpixel P-R, the green subpixels P-G, and the blue subpixel P-B is described in FIG. 14, but embodiments are not limited thereto. The color of a pixel may be changed in various manners.

In the description of FIGS. 1 to 12, a pixel PX is not limited to a specific color, and the red subpixel P-R, the green subpixels P-G, and the blue subpixel P-B are collectively referred to as the pixel PX.

Each of the red subpixel P-R, the green subpixels P-G, and the blue subpixel P-B of FIG. 14 may include the same circuit configuration as a pixel PXij of FIG. 3.

When a second region RB2 displays a blue color image, the blue subpixel P-B in the second region RB2 may receive a data signal Di (refer to FIG. 3) corresponding to a maximum gray scale level (e.g., a gray scale level of 255), and each of the red subpixel P-R and the green subpixel P-G may receive a data signal Di corresponding to a minimum gray scale level (e.g., a gray scale level of 0). Therefore, threshold voltages of first transistors in the red subpixel P-R and the green subpixel P-G in the second region RB2 may be negatively shifted.

In an example shown in FIG. 13, a representative value of each of blocks BK23 to BK25, BK33 to BK35, and BK43 to BK45 may be an arithmetic mean, e.g., (0+0+255)/3=85, of a gray scale level (a gray scale level of 0) corresponding to the red subpixel P-R, a gray scale level (a gray scale level of 0) corresponding to the green subpixel P-G, and a gray scale level (a gray scale level of 255) corresponding to the blue subpixel P-B.

Because the representative values of the blocks BK23 to BK25, BK33 to BK35, and BK43 to BK45 are the same as each other, compensation values CV of pixels in the blocks BK23 to BK25, BK33 to BK35, and BK43 to BK45 may be the same as the representative value, e.g., 85.

A compensation value calculator 220 of an image processor 112 of FIG. 6 may output a compensation value CV corresponding to each of the red subpixel P-R and the green sub-pixel P-G in the second region RB2.

Because gray scale levels corresponding to the red subpixel P-R and the green subpixel P-G in the blocks BK23 to BK25, BK33 to BK35, and BK43 to BK45 are less than or equal to a reference gray scale level, a compensator 230 may output an image data signal DS obtained by compensating for an image signal RGB corresponding to the red subpixel P-R and the green subpixel P-G in the second region RB2 based on the compensation value CV.

In other words, the image signal RGB corresponding to the red subpixel P-R and the green subpixel P-G in the blocks BK23 to BK25, BK33 to BK35, and BK43 to BK45 may be compensated based on the compensation value CV (e.g., 85).

Because the image signal RGB corresponding to the blue subpixel P-B in the blocks BK23 to BK25, BK33 to BK35, and BK43 to BK45 has a gray scale level higher than the reference gray scale level, image processor 112 may output the image signal RGB as an image data signal DS without compensation.

As a result, image processor 112 may minimize the negative shifting of the threshold voltages of transistors in the red subpixel P-R and the green subpixel P-G in the second region RB2.

The display device having such a configuration may provide a pixel with a data signal capable of compensating for a change in characteristic of a pixel in a boundary region between image regions, each of which has a different gray scale level. Thus, the display device may prevent display quality from being degraded inn the boundary region between the image regions.

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device, comprising:

a display panel comprising a plurality of pixels; and a driving circuit configured to receive an image signal and provide a data signal to the plurality of pixels such that an image is displayed on the display panel, wherein:

the driving circuit comprises:

a stress map generator configured to divide the image signal into a plurality of blocks and generate a stress map having a representative value of each of the plurality of blocks;

a compensation value calculator configured to calculate a compensation value corresponding to each of the plurality of pixels based on the stress map; and a compensator configured to output the data signal obtained by compensating the image signal based on the compensation value when a gray scale level of the image signal is less than or equal to a reference gray scale level;

the plurality of pixels comprise first color subpixels, second color subpixels, and third color subpixels, and a compensation value corresponding to each of the first color subpixels, the second color subpixels, and the third color subpixels is set to a representative value of a first block among the plurality of blocks, when the image signal corresponding to each of the first color subpixels in the first block corresponds to a maximum gray scale level and when the image signal corresponding to each of the second color subpixels and the third color subpixels in the first block corresponds to a minimum gray scale level.

2. The display device of claim 1, wherein the stress map has a first representative value of a first block among the plurality of blocks and a second representative value of a second block adjacent to the first block, and wherein the compensation value of a target pixel in the second block is calculated by interpolation calculation using the first representative value and the second representative value.

3. The display device of claim 2, wherein the first representative value of the first block is a compensation value of a first central pixel located at a center of the first block, and wherein the second representative value of the second block is a compensation value of a second central pixel located at a center of the second block.

4. The display device of claim 3, wherein a compensation value of the target pixel is calculated by the first representative value, the second representative value, a distance between the first central pixel and the target pixel, and a distance between the second central pixel and the first central pixel.

5. The display device of claim 3, wherein a compensation value of each of pixels between the first central pixel and the second central pixel gradually decreases as moving from the second central pixel from the first central pixel, when the first representative value is greater than the second representative value.

6. The display device of claim 1, wherein the stress map generator is configured to generate the stress map having a first representative value of a first block among the plurality of blocks and a second representative value of a second block adjacent to the first block, and wherein the compensation value calculator is configured to calculate the compensation value of a target pixel in the second block by interpolation calculation using the first representative value and the second representative value.

7. The display device of claim 1, wherein the compensator is configured to compensate for the image signal corresponding to each of the third color subpixels as the compensation value.

8. The display device of claim 1, wherein each of the plurality of blocks corresponds to A×B pixels, where each of A and B is a natural number.

9. The display device of claim 8, wherein the representative value of each of the plurality of blocks is an arithmetic mean of image signals corresponding to the A×B pixels.

10. The display device of claim 1, wherein each of the plurality of pixels comprises:

a first transistor comprising a first electrode for receiving a first driving voltage, a second electrode, and a gate electrode;

a light emitting diode comprising a first electrode electrically connected to the second electrode of the first transistor and a second electrode for receiving a second driving voltage;

a second transistor comprising a first electrode for receiving the data signal, a second electrode electrically connected to the gate electrode of the first transistor, and a gate electrode for receiving a first scan signal;

a third transistor comprising a first electrode for receiving an initialization voltage, a second electrode electrically connected to the second electrode of the first transistor, and a gate electrode for receiving a second scan signal; and a capacitor connected between the gate electrode of the first transistor and the second electrode of the first transistor.

11. The display device of claim 10, wherein the compensation value is set to a value for compensating for a change in threshold voltage of the first transistor.

12. The display device of claim 11, wherein the driving circuit comprises:

a data driving circuit configured to drive a plurality of data lines connected to the plurality of pixels;

a scan driving circuit configured to drive a plurality of scan lines connected to the plurality of pixels; and a driving controller configured to receive a control signal and the image signal and control the data driving circuit and the scan driving circuit.

13. A display device, comprising:

a display panel comprising a plurality of pixels; and a driving circuit configured to receive an image signal and provide a data signal to the plurality of pixels such that an image is displayed on the display panel, wherein:

each of the plurality of pixels comprises a light emitting diode and at least one transistor for supplying current corresponding to the data signal to the light emitting diode;

wherein the driving circuit comprises:

a stress map generator configured to divide the image signal into a plurality of blocks and generate a stress map having a representative value of each of the plurality of blocks;

a compensation value calculator configured to calculate a compensation value corresponding to each of the plurality of pixels based on the stress map; and a compensator configured to output the data signal obtained by compensating the image signal such that a change in threshold voltage of the at least one transistor is compensated based on the compensation value, when a gray scale level of the image signal is less than or equal to a reference gray scale level;

the plurality of pixels comprise first color subpixels, second color subpixels, and third color subpixels, and a compensation value corresponding to each of the first color subpixels, the second color subpixels, and the third color subpixels is set to a representative value of a first block among the plurality of blocks, when the image signal corresponding to each of the first color subpixels in the first block corresponds to a maximum gray scale level and when the image signal corresponding to each of the second color subpixels and the third color subpixels in the first block corresponds to a minimum gray scale level.

14. The display device of claim 13, wherein the stress map has a first representative value of a first block among the plurality of blocks and a second representative value of a second block adjacent to the first block, and wherein the compensation value of a target pixel in the second block is calculated by interpolation calculation using the first representative value and the second representative value.

15. The display device of claim 14, wherein the first representative value of the first block is a compensation value of a first central pixel located at a center of the first block, and wherein the second representative value of the second block is a compensation value of a second central pixel located at a center of the second block.

16. The display device of claim 15, wherein a compensation value of the target pixel is calculated by the first representative value, the second representative value, a distance between the first central pixel and the target pixel, and a distance between the second central pixel and the first central pixel.

17. The display device of claim 16, wherein each of the plurality of pixels comprises:

a first transistor comprising a first electrode for receiving a first driving voltage, a second electrode, and a gate electrode;

a light emitting diode comprising a first electrode electrically connected to the second electrode of the first transistor and a second electrode for receiving a second driving voltage;

a second transistor comprising a first electrode for receiving the data signal, a second electrode electrically connected to the gate electrode of the first transistor, and a gate electrode for receiving a first scan signal;

a third transistor comprising a first electrode for receiving an initialization voltage, a second electrode electrically connected to the second electrode of the first transistor, and a gate electrode for receiving a second scan signal; and a capacitor connected between the gate electrode and the second electrode of the first transistor.

18. The display device of claim 17, wherein the compensator is configured to output the data signal obtained by compensating the image signal such that a change in the threshold voltage of the at least one transistor is compensated based on the compensation value, when the gray scale level of the image signal is less than or equal to the reference gray scale level.

19. The display device of claim 13, wherein each of the plurality of blocks corresponds to A×B pixels, where each of A and B is a natural number.

20. The display device of claim 13, wherein the compensator is configured to compensate for the image signal corresponding to each of the third color subpixels as the compensation value.

* * * * *